US006647970B2

(12) United States Patent
Hankins

(10) Patent No.: US 6,647,970 B2
(45) Date of Patent: Nov. 18, 2003

(54) EXHAUST GAS RECIRCULATION AND PROCESSING DEVICE FOR TURBOCHARGED DIESEL ENGINE

(75) Inventor: Clarence LeRoy Hankins, Rochester, WA (US)

(73) Assignees: Clarence L. Hankins, Rochester, WA (US); Fred Burk, Olympia, WA (US); George Jansen, Rochester, WA (US); Larry Gibson, SeaTac, WA (US); Les Thompson, Vancouver, WA (US)

( * ) Notice: Subject to any disclaimer, the term of this patent is extended or adjusted under 35 U.S.C. 154(b) by 291 days.

(21) Appl. No.: 09/901,261

(22) Filed: Jul. 9, 2001

(65) Prior Publication Data

US 2003/0010327 A1 Jan. 16, 2003

(51) Int. Cl.[7] ..... F02M 25/07

(52) U.S. Cl. ..... 123/568.12; 60/605.2; 123/568.15

(58) Field of Search ..... 123/568.11, 568.12, 123/568.15, 568.17; 60/274, 278, 289, 602, 605.2

(56) References Cited

U.S. PATENT DOCUMENTS

| | | | | | |
|---|---|---|---|---|---|
| 3,306,035 | A | | 2/1967 | Morrell | |
| 3,774,399 | A | | 11/1973 | Nohira et al. | |
| 3,991,567 | A | | 11/1976 | Brimer | |
| 5,333,447 | A | * | 8/1994 | Goodrich | 60/278 |
| 5,802,846 | A | * | 9/1998 | Bailey | 60/278 |
| 5,937,650 | A | | 8/1999 | Arnold | |
| 5,974,802 | A | * | 11/1999 | Blake | 60/605.2 |
| 6,016,788 | A | | 1/2000 | Kibe et al. | |
| 6,032,656 | A | | 3/2000 | Itoyama et al. | |
| 6,038,860 | A | | 3/2000 | Bailey | |
| 6,089,019 | A | | 7/2000 | Roby et al. | |
| 6,112,729 | A | | 9/2000 | Barnes et al. | |
| 6,230,695 | B1 | * | 5/2001 | Coleman et al. | 123/568.12 |
| 6,237,336 | B1 | * | 5/2001 | Feucht et al. | 60/605.2 |
| 6,427,436 | B1 | * | 8/2002 | Allansson et al. | 60/274 |
| 6,532,735 | B2 | * | 3/2003 | Luercho | 60/278 |

* cited by examiner

*Primary Examiner*—Willis R. Wolfe
(74) *Attorney, Agent, or Firm*—Brian J. Coyne

(57) ABSTRACT

An exhaust gas recirculation and processing device for a turbocharged diesel engine. A reactor comprises an inner chamber substantially surrounded by an outer chamber. Within the inner chamber, compressed air from the turbocharger mixes with engine exhaust gases discharged through the turbocharger. The mixture is heated and reacts to combust pollutants as it passes by a copper tube and baffle within the inner chamber. The reacted mixture exits the inner chamber and enters the outer chamber with which it communicates through apertures in a separating wall; from the outer chamber the reacted mixture is conducted to the engine intake. The copper tube and baffle are heated to within an optimal temperature range by directing gaseous engine combustion products through the copper tube. A heat exchanger thermally coupled to the reactor exchanges heat between the reactor and the engine cooling system to maintain reactor temperature. The gaseous discharge from the copper tube is directed to the engine exhaust pipe during engine cold start, and is diverted toward the reactor inner chamber when the engine warms up.

10 Claims, 7 Drawing Sheets

EXHAUST GAS RECIRCULATION AND PROCESSING DEVICE FOR TURBOCHARGED DIESEL ENGINE

CROSS REFERENCE TO RELATED APPLICATIONS

None.

BACKGROUND OF THE INVENTION

1. Field of the Invention

This invention relates in general to recirculation type engine exhaust cleaning devices, and more particularly to such devices for turbocharged diesel engines that oxidize engine combustion products by combining engine exhaust gases with turbocharged, fresh air inside a temperature-controlled reactor.

2. Background Art

It has long been known that the levels of $NO_x$, unburnt hydrocarbons and particulates in internal combustion engine exhaust can be reduced by mixing a portion of the engine exhaust with fresh air and recirculating the mixture through the engine intake for further combustion; see, for example, U.S. Pat. No. 6,032,656 to Itoyama et al., U.S. Pat. No. 6,016,788 to Kibe et al., and U.S. Pat. No. 6,112,729 to Barnes et al. In particular, devices have been disclosed for applying this concept to turbocharged diesel engines; see U.S. Pat. No. 6,038,860 to Bailey and U.S. Pat. No. 5,937, 650 to Arnold. To assure proper flow of the recirculated gases, it was further known to use a restrictor valve to create a pressure differential between the engine intake and exhaust; see U.S. Pat. No. 6,089,019 to Roby et al. It was also known to use the recycled gases to reduce the operating temperature within the cylinder combustion chambers of an engine equipped with a recirculation type exhaust gas cleaning system in order to decrease the nitrogen oxide content in the exhaust gas; see U.S. Pat. No. 3,774,399 to Nohira et al.

Unlike the foregoing, the present invention includes a temperature-controlled reactor external to the engine block for mixing and reacting recycled engine exhaust gases with pressurized, fresh air in order to oxidize engine combustion products; the mixed, reacted gases are then conducted to the engine intake for recombustion. Because the reactor is remote from the cylinder combustion chambers, conditions can be optimized within the reactor for removal of $NO_x$, unburnt hydrocarbons and particulates without compromising conditions within the cylinder combustion chambers. U.S. Pat. No. 3,991,567 to Brimer and U.S. Pat. No. 3,306, 035 to Morrell each disclosed exhaust cleaning systems of the non-recirculating type, wherein exhaust pollutants are oxidized in a combustion chamber that is external to the engine block, but in each the cleaned exhaust is directed through a tail pipe to the atmosphere instead of being recirculated back into the engine cylinders. By including an external, temperature-controlled reactor within an exhaust gas recycling device, the present invention achieves previously unattainable low levels of exhaust pollutants in a turbocharged diesel engine.

SUMMARY OF THE INVENTION

What is needed, therefore, and what my device provides, is an exhaust gas recirculation and processing device for a turbocharged diesel engine that includes a temperature-controlled reactor, remote from the cylinder combustion chambers, within which engine combustion products are mixed and reacted with pressurized, fresh air to achieve low levels of $NO_x$, unburnt hydrocarbons and particulates in the engine exhaust. To that end, an inlet pipe is connected to receive the gaseous combustion products of a diesel engine equipped with a turbocharger. A longitudinally-extended, reactor is provided. The reactor includes a housing that contains a first, inner chamber and a second, outer chamber that substantially surrounds the inner chamber. The inner chamber communicates with the outer chamber through slotted openings. The reactor has air inlet means that communicates with the inner chamber and with the inlet pipe, and air outlet means that communicates with the outer chamber for conducting air to the engine intake manifold. Disposed within the inner chamber is a recirculated exhaust gas combustion assembly comprised of a longitudinally-extended copper tube having an inlet end and an opposite outlet end; and a longitudinally-extended, copper baffle attached to the tube. An exhaust feed pipe extends from the exhaust outlet port of the turbocharger to the inlet end of the copper tube. A reactor output pipe has a first end in communication with the outlet end of the copper tube and an opposite, second end in communication with the inlet pipe. A pressurized air pipe extends from the air outlet port of the turbocharger to the air inlet means. Inlet valve means is provided for adjusting the flow rate of gaseous combustion products from the engine through the inlet pipe. To maintain a pressure differential between the engine intake and exhaust, restrictor means is provided in communication with the outlet end of the copper tube that impedes flow of gaseous combustion products from the engine through the tube.

In order to maintain the temperature of the reactor within a temperature range that facilitates the removal of CO, $NO_x$ and unburnt hydrocarbons, heat exchanger means is thermally coupled to the reactor exhaust outlet pipe and exchanges heat with the engine cooling system. Preferably, the reactor temperature is maintained between 124 and 195 degrees Fahrenheit for best removal of pollutants.

In a first embodiment of the device, the baffle comprises two flat, longitudinally-disposed, copper vanes attached to an exterior surface of the copper tube. In an alternative embodiment, the baffle comprises a plurality of radially and longitudinally-disposed, copper vanes attached to an exterior surface of the copper tube.

The inlet valve means includes a first valve assembly that restricts gaseous flow through the inlet pipe during cold start up of the engine, and thereafter, when engine temperature reaches a desired operating temperature, permits flow of gaseous engine combustion products through the inlet pipe and into the copper tube. The inlet valve means further includes a second valve assembly that permits flow of gaseous engine combustion products through the engine exhaust pipe during cold start up of the engine, and thereafter, when engine temperature reaches a desired operating temperature, substantially diverts flow into the inlet pipe and thence into the copper tube.

The first valve assembly includes a first, normally closed, butterfly valve, a first linear actuator coupled to said valve, and means for energizing said actuator to open said valve when the engine is at or above a desired operating temperature. The second valve assembly includes a second, normally open, butterfly valve, a second linear actuator coupled to said valve, and means for energizing said actuator to close said valve when the engine is at or above a desired operating temperature. An electrical control sytem for controlling the inlet valve means is provided, which can be either manually or automatically controlled.

DESCRIPTION OF THE PREFERRED EMBODIMENTS

Figure 1:
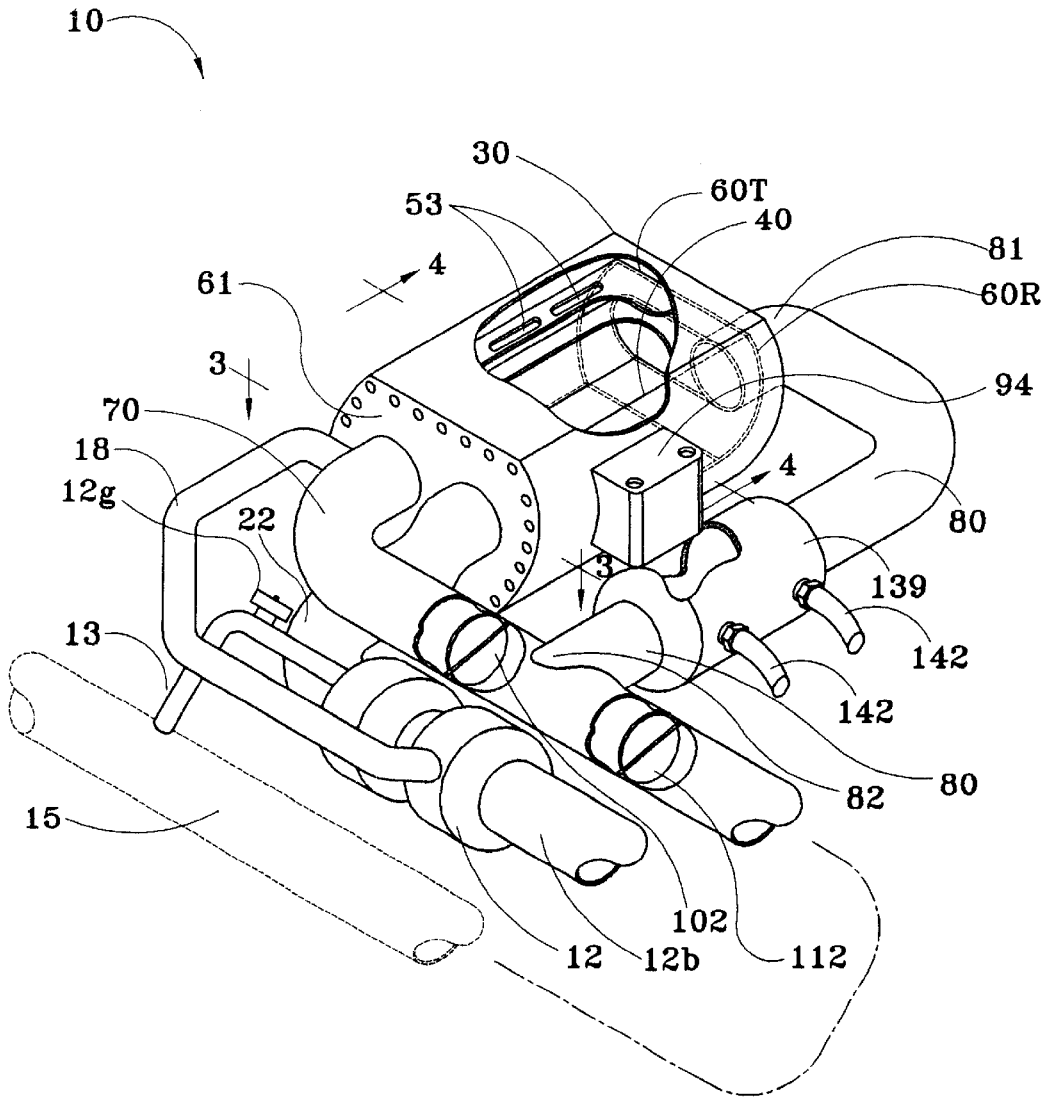
FIG. 1 is a perspective view of the exhaust gas recirculation device of the present invention for a turbocharged diesel engine, showing the reactor in cutaway view.
Figure 2:
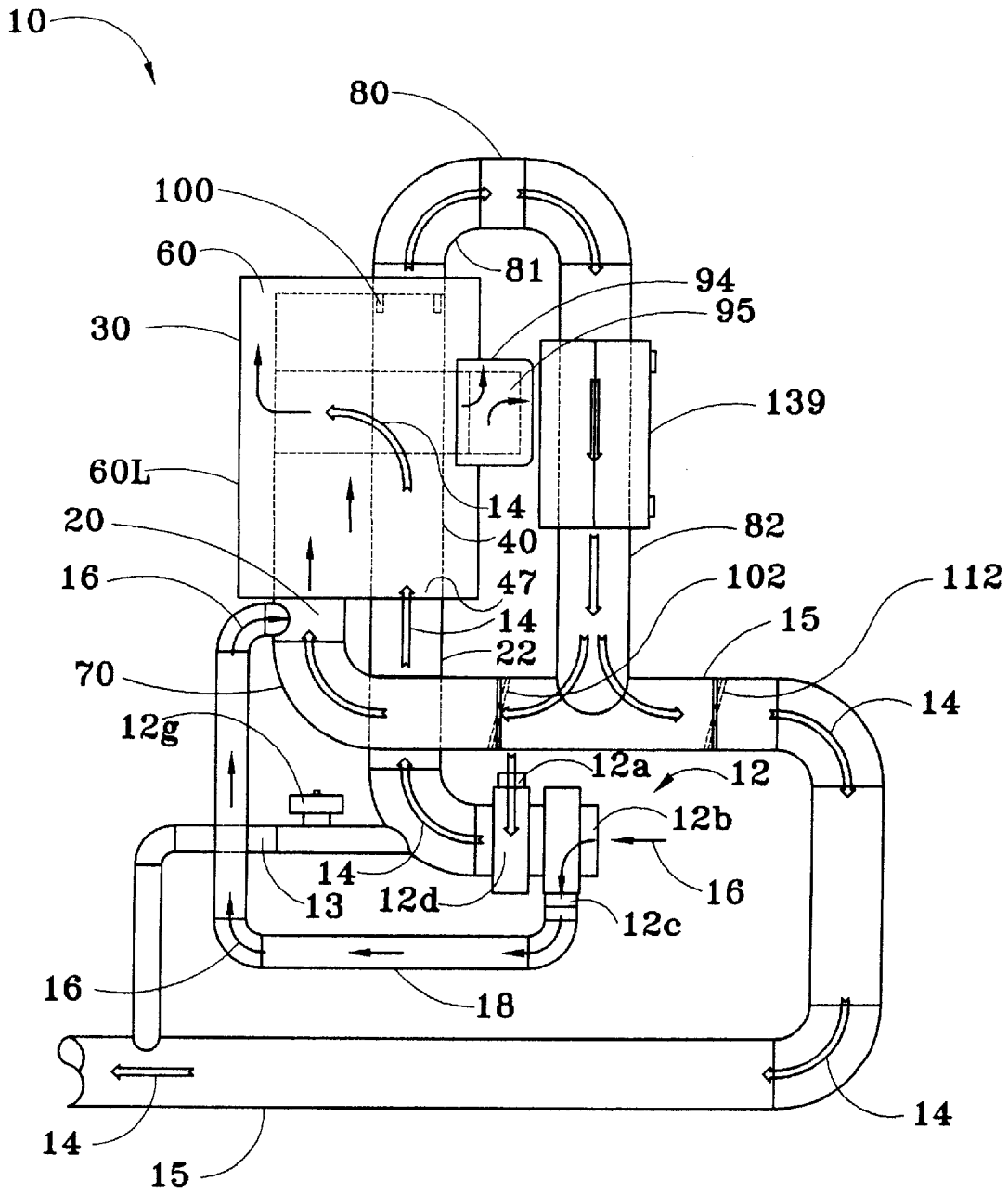
FIG. 2 is a schematic representation thereof.
Figure 3:
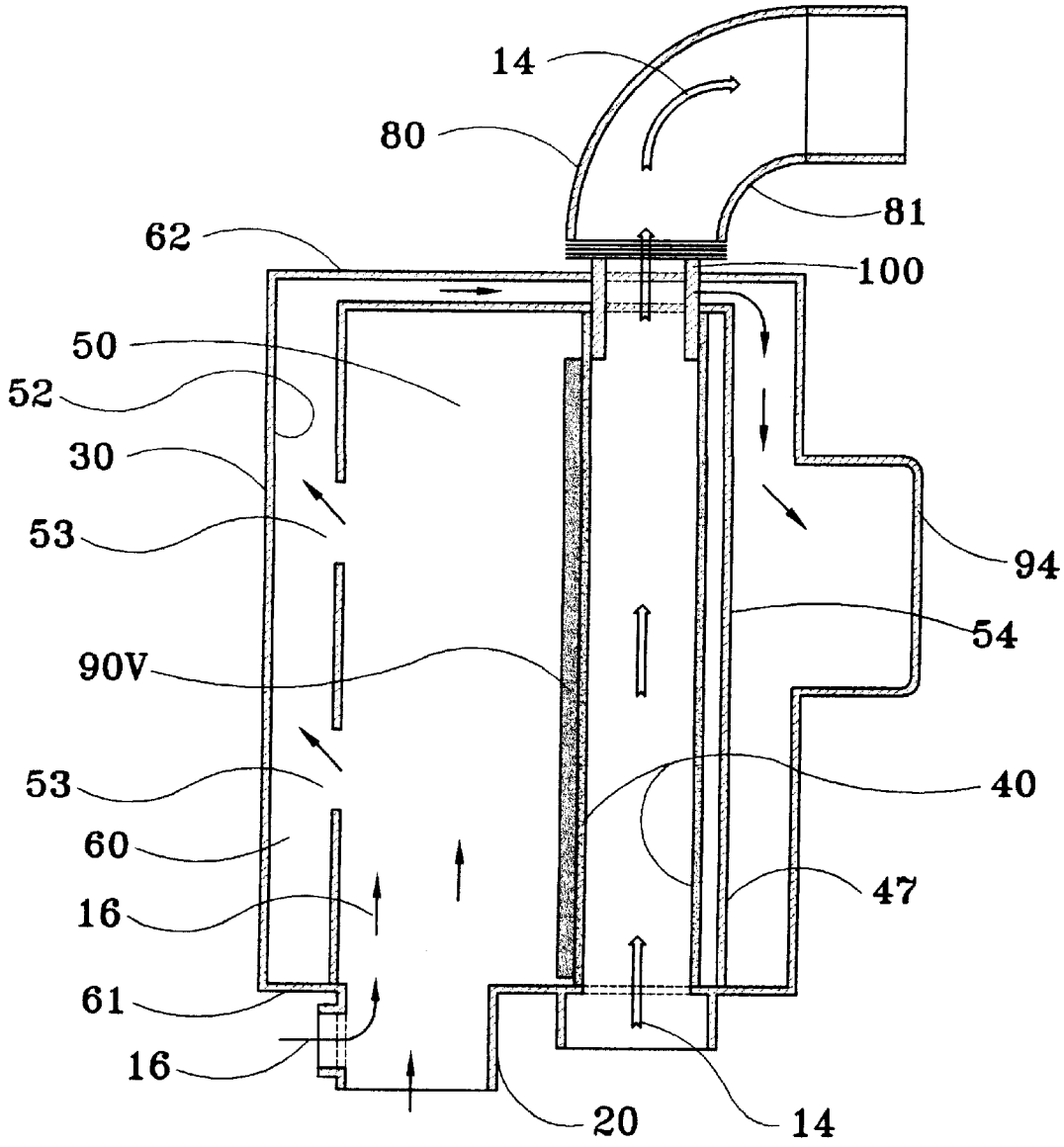
FIG. 3 is an enlarged, transverse, cross-sectional view of the reactor taken along line 3—3 of FIG. 1.

An exhaust gas recirculation and processing device for a turbocharged disel engine, denoted generally by the numeral 10, is depicted in perspective view in FIG. 1 and in schematic representation in FIG. 2. The gaseous combustion products of a diesel engine (not shown), the flow of which is denoted by arrows 14, are conducted in the conventional manner from the engine exhaust manifold to the exhaust inlet port 12*a* on the exhaust wheel side of a turbocharger 12. Fresh air, the movement of which is denoted by arrows 16, enters the turbocharger inlet port 12*b*, is pressurized by a blower wheel coupled to the exhaust wheel (not shown), and is conducted through outlet port 12*c* under pressure through pressurized air pipe 18 to air inlet means 20 attached to a first end of reactor 30. The turbocharger 12 has a waste gate 12*g* installed in waste line 13, which communicates with exhaust pipe 15, to relieve excess pressure on the exhaust wheel of the turbocharger 12. The turbocharger 12, waste gate 12*g* and waste line 13 are conventional and form no part of the invention.

Figure 4:
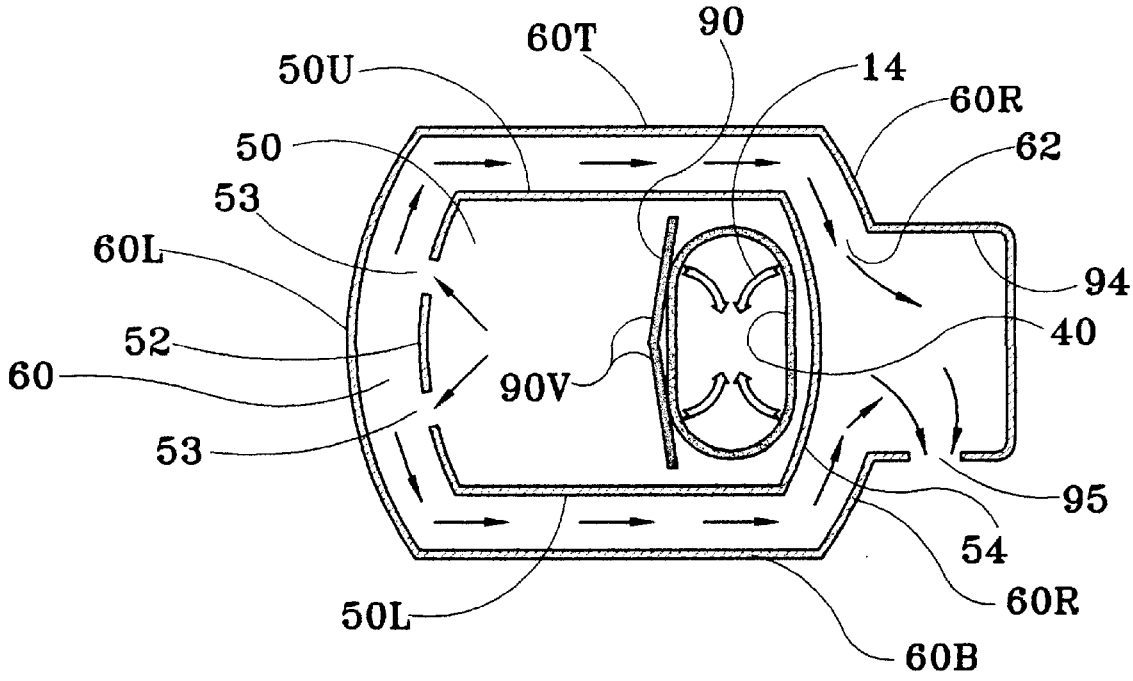
FIG. 4 is an enlarged, longitudinal, cross-sectional view of the reactor taken along line 4—4 of FIG. 1.

The engine combustion products exit the turbocharger 12 through exhaust oulet port 12*d* and are conducted by an exhaust feed pipe 22 to a first, inlet end 47 of a copper tube 40 inside the reactor 30. The reactor 30 has an inner chamber 50 defined by an upper wall 50U and a lower wall 50L joined by a left side wall 52, a right side wall 54, and a rear wall 58, as may best be seen in FIG. 4. Substantially surrounding the interior chamber 50 is an exterior chamber 60 defined by a reactor casing, comprised of a top wall 60T and bottom wall 60B joined by a left side wall 60L, a right side wall 60R, a front wall 61 and a rear wall 62. The air inlet means 12 is mounted on the casing front wall 61 and is in communication with the interior chamber 50. Coupled to the air inlet means 12 is an inlet pipe 70 connected to receive the gaseous combustion products from the engine.

Figure 5:
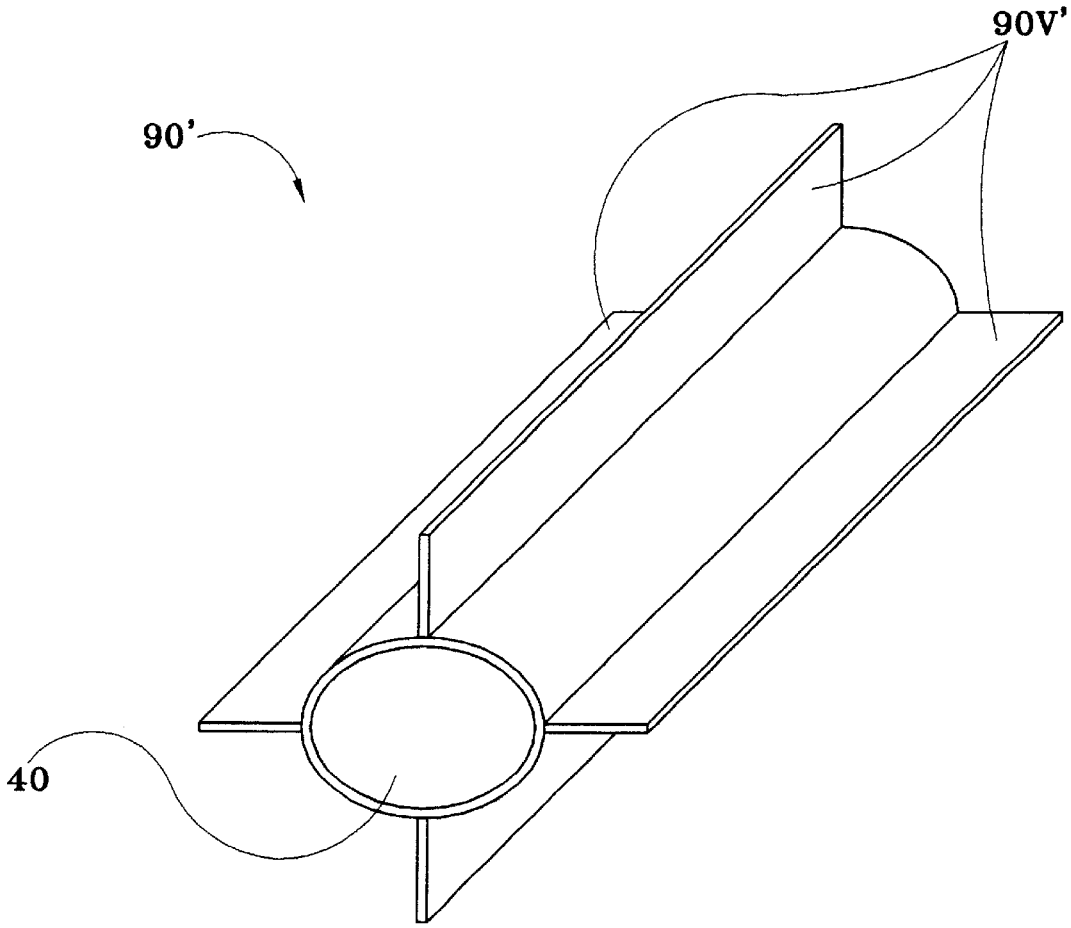
FIG. 5 is a perspective view of the copper tube and baffle of an alternative embodiment of the invention.

The copper tube 40 extends longitudinally from the front wall 61 to the rear wall 62 where it communicates with a first end 81 of a reactor exhaust outlet pipe 80. A second, opposite end 82 of the pipe 80 communicates with the inlet pipe 70; thus, combustion products from the engine that enter the inlet end 81 of the copper tube 40 are routed through the inlet pipe 70 into the inlet means 20 where they are mixed with fresh air as they enter the interior chamber 50. Attached to the copper tube 40 is a longitudinally-extended baffle 90 comprised of a pair of copper vanes 90V. As the combustion products flow through the copper tube 40, the vanes 90V become hot enough to oxidize the combustion products flowing past them. In an alternative embodiment, the baffle 90' comprises a plurality of radially-directed, longitudinally-extended, copper vanes 90V' attached to the copper tube 40; see FIG. 5. The oxidized gases then exit the interior chamber 50 through longitudinally-extended slots 53 in the left wall 52 into the exterior chamber 60, pass through the exterior chamber 60, and exit the reactor 30 through air outlet means—i.e., an intake coupling 94 and aperture 95 formed in casing right wall 60R—for passage into the engine intake. The front wall 61 of the reactor 30 is, of course, suitably apertured for receiving fresh air and gaseous combustion products from the inlet air means 20 mounted thereon, as well as for receiving the exhaust output from the turbocharger outlet port 12*d*; likwise, the reactor rear wall 62 is apertured to permit flow from the copper tube 40 into the inlet end 81 of the reactor exhaust outlet pipe 80.

Figure 7:
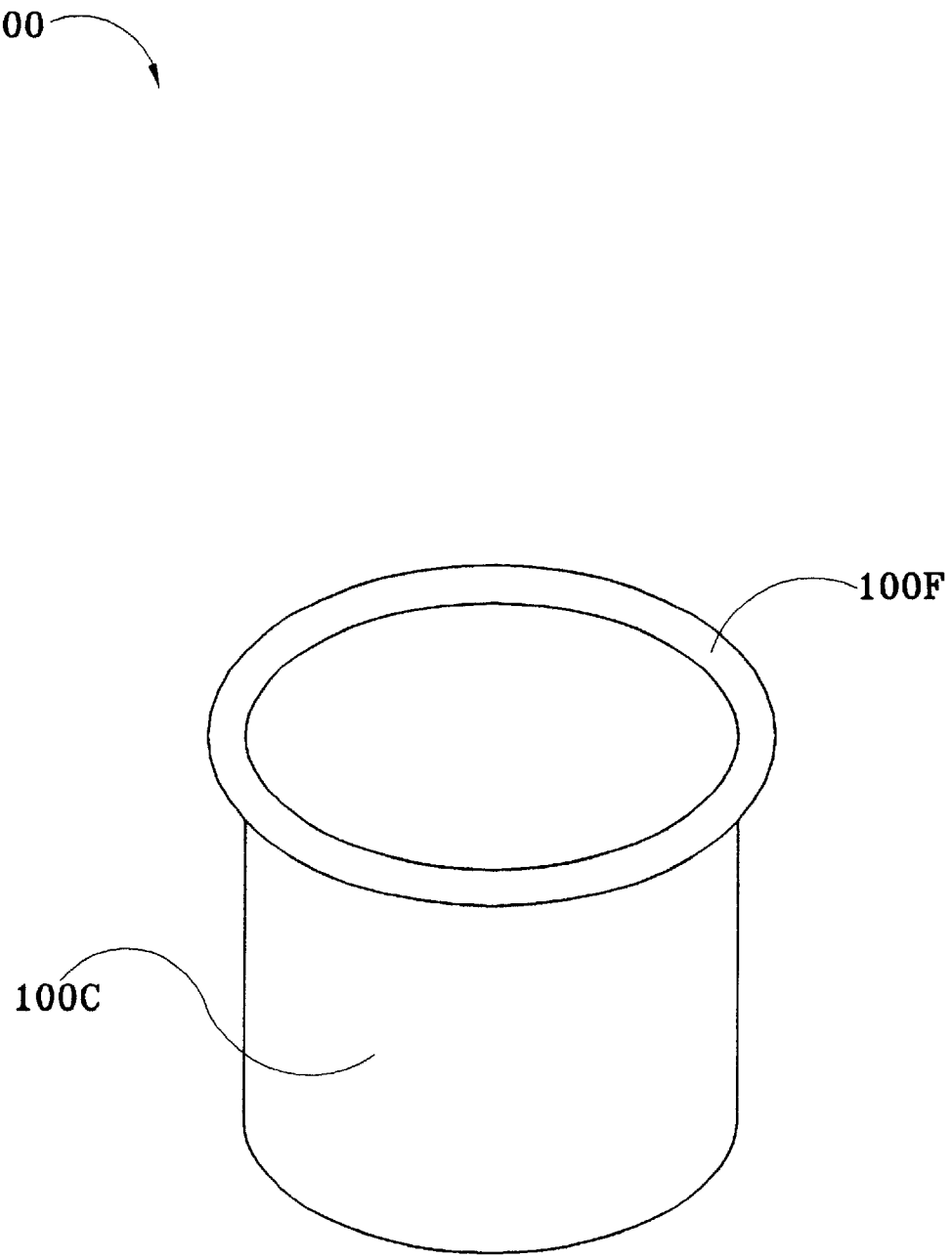
FIG. 7 is a perspective view of a restrictor removed from the device.

A restrictor 100, comprising a cylinder portion 100C and a flange portion 100F as depicted in FIG. 7, is inserted into the outlet end of the copper tube 40 to impede flow of gaseous combustion products from the engine through the tube 40 in order to maintain a pressure differential between the intake and exhaust sides of the engine. The optimum size of the restrictor 100 can be determined by trial and error for a particular engine, and once determined, the restrictor 100 can be installed permanently.

Figure 6:
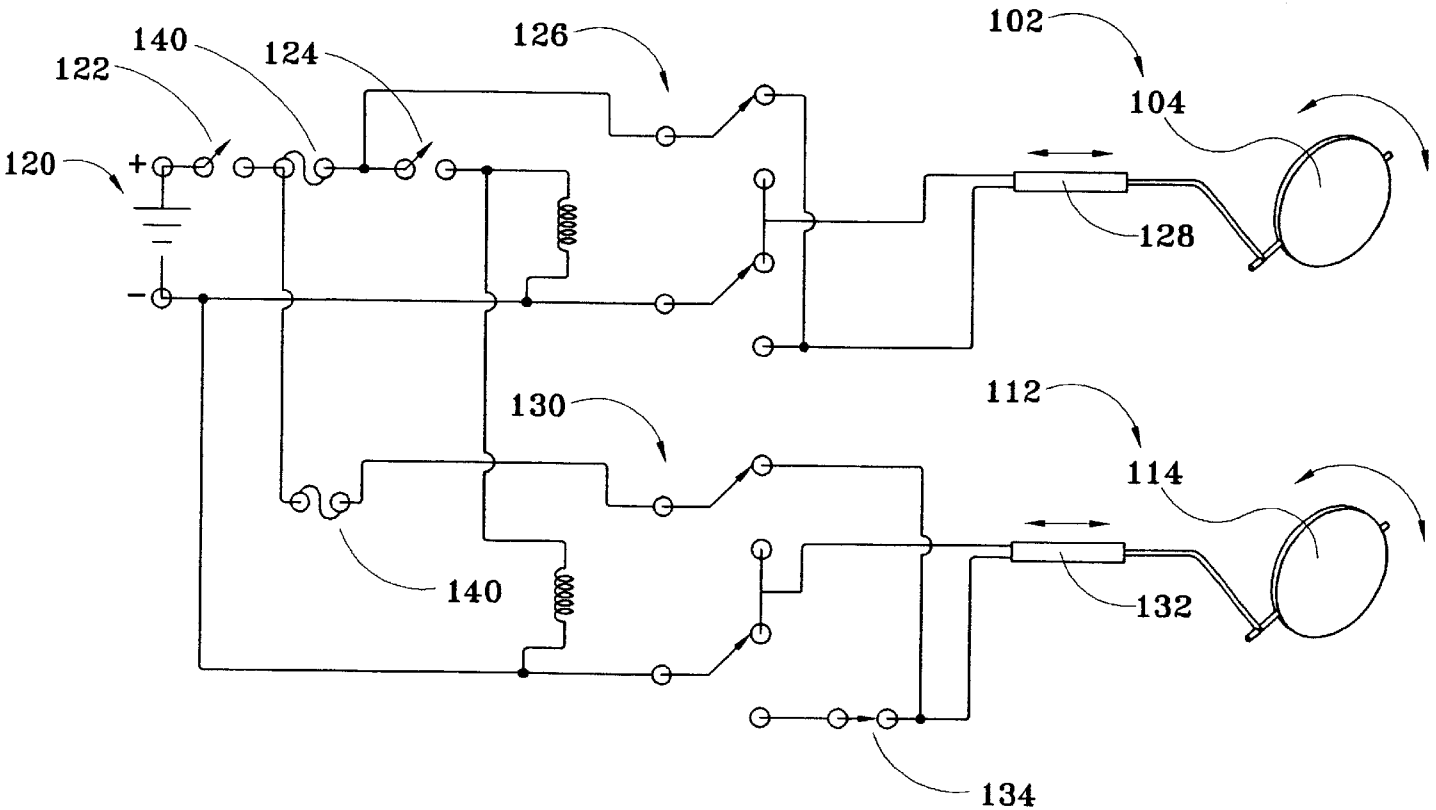
FIG. 6 is a schematic drawing of the electrical control of the inlet valve means.

For efficient combustion of gaseous combustion products from the engine, the reactor 30 should be heated to, and maintained at, 124 to 195 degrees Fahrenheit; for that purpose, a heat exhanger 139 is thermally coupled to the reactor exhaust outlet pipe 80 and exhanges heat with the engine coolant system via coolant hoses 142. During cold start up of the engine, all gaseous combustion products from the engine are diverted away from the reactor 30 and directed to the exhaust pipe 15. Once the engine has warmed up to a desired operating temperature however, a portion of the engine exhaust products pass through the reactor 30 for processing. This is accomplished by inlet valve means, which in a preferred embodiment includes a first valve assembly 102 that restricts gaseous flow through the inlet pipe 70 toward the reactor 30 during cold start until the engine has warmed up, and a second valve assembly 112 that permits exhaust gases to escape out the exhaust pipe 15 during cold start until the engine has warmed up. Referring to FIG. 6, in a preferred embodiment the first valve assembly 102 includes a first, normally closed, butterfly valve 104 mounted for rotation within the inlet pipe 70, a first linear actuator 128 coupled to said valve, and means for actuating said actuator when the engine warms up. Similarly, the second valve assembly 112 includes a second, normally open, butterfly valve 114 mounted for rotation within the exhaust pipe 15, a second linear actuator 132 coupled to the second valve, and means for actuating said actuator when the engine warms up in order to substantially close the second valve. A suitable linear actuator for a 12 volt engine electrical system, for instance, is the ELECTRAK 1 model S12-094A4-04, available from Warner Electric of South Beloit, Ill., which comes equipped with a limit switch. Manual means for energizing the first and second linear actuators includes: a direct current power source 120; a power on/off switch 122 in series with said source; an actuator switch 124 in series with switch 122 that applies voltage to a first relay switch 126, which, when energized, retracts the normally extended arm of the actuator 128 attached to the first butterfly valve 104; a second relay switch 130 wired in parallel to the first relay switch 126, which, when energized, extends the normally retracted arm of the actuator 132 attached to the second butterfly valve 114, thereby substantially closing it. Associated with the second actuator 132 is a limit switch 134 that deenergizes the second actuator 112 when the second butterfly valve 116 attains a preselected, partially closed position. Preferably, separate six to ten ampere fuses 140 are wired in series with relay switches 126 and 130, as depicted in FIG. 6.

The device 10 is capable of markedly reducing the levels of exhaust pollutants from a turbocharged diesel engine. In air quality tests performed by AmTest-Air Quality, LLC, of Preston, Wash., the following results were obtained on a Cummins Diesel Engine Big Cam 4 fitted with the device and installed in a 1990 T600A Kenworth Truck:

| | Run 1 | Run 2 | Run 3 | Average |
|---|---|---|---|---|
| Nitrogen Oxides | | | | |
| Emission Conc. (ppm) | 848.9 | 786.7 | 801.5 | 812.4 |
| Emission Rate (lb/hr) | 2.34 | 2.19 | 2.24 | 2.26 |
| Emission Rate (tons/yr) | 10.2 | 9.61 | 9.81 | 9.89 |
| Emission Rate (g/BHP-hr) | 3.37 | 3.16 | 3.22 | 3.25 |
| Carbon Monoxide | | | | |
| Emission Conc. (ppm) | 965.0 | 1238.4 | 1267.6 | 1157.0 |
| Emission Rate (lb/hr) | 1.62 | 2.10 | 2.16 | 1.96 |
| Emission Rate (tons/yr) | 7.09 | 9.21 | 9.45 | 8.58 |
| Emission Rate (g/BHP-yr) | 2.33 | 3.03 | 3.11 | 2.82 |
| Total Hydrocarbons | | | | |
| (THC as Propane) | | | | |
| THC Emission Conc. | | | | |
| (ppm, wet) | 0.0 | 0.9 | 1.0 | 0.6 |
| (ppm, dry) | 0.0 | 1.01 | 1.12 | 0.710 |
| Emission Rate (lb/hr) | 0.0 | 0.003 | 0.003 | 0.002 |
| Emission Rate (tons/yr) | 0.0 | 0.012 | 0.013 | 0.008 |
| Emission Rate (g/BHP-hr) | 0.0 | 0.004 | 0.004 | 0.003 |

These results far exceed the emission standards for heavy duty diesel engines set by the U.S. Envinronmental Protection Agency and the California Air Research Board for the model years 1987–2003.

It will be appreciated that various modifications can be made to the exact form of the present invention without departing from the scope thereof. For instance, as is known to persons of ordinary skill in the art, control of the first and second valve assemblies can be automated using a temperature sending unit attached to the reactor for sending a signal to an engine control unit that will automatically initiate actuation of said valve assemblies once the reactor is within the desired temperature range. The tube and baffle are preferably made of copper, but brass, ceramic or other materials might be substituted for copper. It is accordingly intended that the disclosure be taken as illustrative only and not limiting in scope, and that the scope of the invention be defined by the following claims.

What is claimed is:

1. An exhaust gas processing device for use with a diesel engine equipped with a turbocharger and turbocharger waste gate, comprising:

an inlet pipe connected to receive the gaseous combustion products from said engine;

a longitudinally-extended, reactor including a housing containing a first, inner chamber with slotted openings and a second, outer chamber that substantially surrounds the inner chamber and communicates therewith through said slotted openings, air inlet means communicating with the inner chamber and with the inlet pipe, air outlet means communicating with the outer chamber for conducting air to the engine intake manifold, and a recirculated exhaust gas combustion assembly disposed within the inner chamber, said assembly including a longitudinally-extended tube, said tube having an inlet end and an opposite, outlet end;

a longitudinally-extended, baffle attached to the tube;

a pressurized air pipe for conducting fresh, turbocharged air from the turbocharger to the air inlet means;

an exhaust feed pipe for conducting gaseous engine combustion products from the turbocharger to the inlet end of the tube;

a reactor exhaust outlet pipe having a first end in communication with the outlet end of the tube and an opposite, second end in communication with the inlet pipe;

inlet valve means for adjusting the flow rate of gaseous engine combustion products from the engine through the inlet pipe;

restrictor means in communication with the outlet end of the tube to impede flow of gaseous engine combustion products from the engine through said tube; and heat exchanger means thermally coupled to the recycler pipe for maintaining the temperature of the reactor within a temperature range that facilitates the removal of CO, NOx and unburnt hydrocarbons.

2. The device of claim 1, wherein the temperature range is 124 to 195 degrees Fahrenheit.

3. The device of claim 2, wherein the tube and baffle are metal.

4. The device of claim 3, wherein the tube and baffle are coppper.

5. The device of claim 4, wherein the baffle comprises two flat, longitudinally-disposed, copper vanes attached to an exterior surface of the copper tube.

6. The device of claim 4, wherein the baffle comprises a plurality of radially and longitudinally-disposed, copper vanes attached to an exterior surface of the copper tube.

7. The device of claim 2, wherein the inlet valve means includes a first valve assembly that restricts flow of gaseous engine combustion products through the inlet pipe into the tube during cold start up of the engine, and thereafter, when engine temperature reaches a desired operating temperature, permits flow of said gaseous products into the tube.

8. The device of claim 7, wherein the inlet valve means further includes a second valve assembly that, during engine cold start up, permits gaseous engine combustion products to flow through the exhaust pipe, and thereafter, when engine temperature reaches a desired operating temperature, substantially diverts said gaseous products through the inlet tube and into the tube.

9. The device of claim 8, wherein the first valve assembly includes a first, normally closed, butterfly valve, a first linear actuator coupled to said valve, and means for energizing said actuator to open said valve when the engine temperature is at or above a desired operating temperature.

10. The device of claim 9, wherein the second valve assembly includes a second, normally open, butterfly valve, a second linear actuator coupled to said valve, and means for energizing said actuator to substantially close said valve when the engine temperature is at or above a desired operating temperature.

* * * * *